US006475556B1

(12) United States Patent
Sobczak et al.

(10) Patent No.: US 6,475,556 B1
(45) Date of Patent: Nov. 5, 2002

(54) METHOD FOR PRODUCING FAST DRYING MULTI-COMPONENT WATERBORNE COATING COMPOSITIONS

(75) Inventors: Jeffrey Joseph Sobczak, Coatesville, PA (US); Ann Robertson Hermes, Ambler, PA (US); Donald Craig Schall, Lansdale, PA (US); Angelo Sanfilippo, Biot (FR)

(73) Assignee: Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 09/548,591

(22) Filed: Apr. 13, 2000

(30) Foreign Application Priority Data

Nov. 25, 1999 (FR) ..... 99 14865

(51) Int. Cl.[7] ..... B05C 1/16; B05D 5/10; E01C 11/24; E01C 17/00; E01C 5/00

(52) U.S. Cl. ..... 427/137; 427/136; 427/407.1

(58) Field of Search ..... 427/136, 137, 427/407.1; 404/94

(56) References Cited

U.S. PATENT DOCUMENTS

| | | | | |
|---|---|---|---|---|
| 3,661,815 | A | 5/1972 | Smith | 260/17.4 |
| 3,784,391 | A | 1/1974 | Kruse et al. | 106/170 |
| 3,935,099 | A | 1/1976 | Weaver et al. | 210/43 |
| 3,959,569 | A | 5/1976 | Burkholder, Jr. | 428/475 |
| 4,076,663 | A | 2/1978 | Masuda et al. | 260/17.4 |
| 4,124,748 | A | 11/1978 | Fujimoto et al. | 526/8 |
| 4,286,082 | A | 8/1981 | Tsubakimoto et al. | 526/240 |
| 4,389,513 | A | 6/1983 | Miyazaki | 525/186 |
| 4,427,836 | A | 1/1984 | Kowalski et al. | 525/301 |
| 4,469,825 | A | 9/1984 | Kowalski et al. | 523/201 |
| 4,594,363 | A | 6/1986 | Blankenship et al. | 521/64 |
| 4,650,716 | A | 3/1987 | Gelman | 428/402 |
| 4,654,039 | A | 3/1987 | Brandt et al. | 604/368 |
| 4,689,408 | A | 8/1987 | Gelman et al. | 536/98 |
| 4,798,691 | A | 1/1989 | Kasai et al. | 264/47 |
| 4,880,842 | A | 11/1989 | Kowalski et al. | 521/64 |
| 4,906,717 | A | 3/1990 | Cretenot et al. | 526/312 |
| 4,908,271 | A | 3/1990 | Kasai et al. | 428/402 |
| 4,972,000 | A | 11/1990 | Kawashima et al. | 521/54 |
| 5,075,399 | A | 12/1991 | Ahmed et al. | 526/287 |
| 5,494,971 | A | 2/1996 | Blankenship | 525/301 |
| 5,672,379 | A | 9/1997 | Schall et al. | 427/137 |
| 5,804,627 | A | 9/1998 | Landy et al. | 524/314 |
| 5,820,993 | A | 10/1998 | Schall et al. | 428/447 |
| 5,824,734 | A * | 10/1998 | Yang | 524/555 |
| RE36,032 | E | 1/1999 | Toa et al. | 514/58 |
| 5,861,188 | A * | 1/1999 | Schall et al. | 427/137 |
| 5,922,398 | A * | 7/1999 | Hermes et al. | 427/137 |
| 5,947,632 | A * | 9/1999 | Pirotta et al. | 404/9 |

FOREIGN PATENT DOCUMENTS

| | | |
|---|---|---|
| EP | 0 066 108 B1 | 5/1982 |
| EP | 0 68 189 B1 | 6/1982 |
| EP | 0 200 249 B1 | 4/1986 |
| EP | 0 304 143 B1 | 4/1988 |
| EP | 0 322 188 B1 | 12/1988 |
| EP | 0 409 459 B2 | 7/1990 |
| EP | WO 96/22338 | 1/1996 |
| EP | 0 915 108 A1 | 10/1998 |
| JP | 5112 5468 | 10/1976 |
| JP | 1185311 A | 7/1980 |
| JP | 55108407 A | 8/1980 |
| JP | 55133413 | 10/1980 |
| JP | 58154709 | 9/1983 |
| JP | 58154710 | 9/1983 |
| JP | 6217336 | 6/1987 |
| JP | 21440272 A | 5/1990 |
| JP | 62156387 | 7/1998 |
| WO | WO 98/52698 | 5/1998 |

OTHER PUBLICATIONS

Emulsion Polymerization of Acrylic Monomers, Feb. 1997, Rohm and Haas Company.

* cited by examiner

*Primary Examiner*—Michael Barr
*Assistant Examiner*—Rebecca A. Blanton

(57) ABSTRACT

The invention relates to a method for producing a fast drying two or multi-component waterborne coating on a surface of a substrate. The method comprises applying a first component comprising a binder and a second component, being separate from the first component prior to application, comprising an absorber, and compositions and/or formulations prepared therefrom.

47 Claims, No Drawings

METHOD FOR PRODUCING FAST DRYING MULTI-COMPONENT WATERBORNE COATING COMPOSITIONS

The present invention relates to a method for producing fast-drying multi-component waterborne coating compositions, particularly traffic paints or road markings. The invention also relates to the compositions of fast-drying multi-component waterborne coatings, particularly traffic paints or road markings. Used herein, the term "multi-component" refers to traffic paints having two or more components applied to a substrate in one or more steps.

One of the many important features of coatings in general, and road markings or traffic paints in particular, is the speed at which they dry on the surface of a particular substrate after application. For instance, the drying speed of a traffic paint dictates the length of the period of disruption to road traffic during application of the paint to road surfaces, and subsequent drying. The trend is to demand shorter and shorter disruptions of traffic flow, and to meet this demand by using faster drying paint. Used herein, the terms "coating" and "paint" will be used interchangeably and referred to as a general class including traffic paints and road markings. In addition, the terms "traffic paint" and "road marking" are used interchangeably herein.

Solvent-based fast-drying coatings are based on organic polymeric resins (also frequently called binders) dissolved, suspended or otherwise dispersed in relatively low-boiling organic solvents. Low-boiling volatile organic solvents evaporate rapidly after application of the paint on the road to provide the desired fast drying characteristics of a freshly applied road marking. However, in addition to releasing volatile organic solvents into the environment, this type of paint formulation tends to expose the workers to the vapors of the organic solvents. Because of these shortcomings and increasingly stringent environmental mandates from governments and communities, it is highly desirable to develop more environmentally friendly coatings or paints while retaining fast drying properties and/or characteristics.

A more environmentally friendly coating uses water based, i.e., waterborne, rather than solvent based polymers or resins. Coating formulations, both solvent based and waterborne, include binders. The terms "binder" and "binder polymer" used herein refer to polymers that are included in the coating composition and that augment or participate in film formation and in the composition of the resultant film. Binder polymers typically have Tg values in the range −10° C. to 70° C., because those having Tg values below −10° C. tend to have poor resistance to dirt pick-up and those having Tg values above 70° C. usually display diminished ability to form films. In certain applications, however, the lower limit for Tg can be even lower than −10° C. For example, the binder polymers used in roof coatings can have glass transition temperatures as low as −40° C. Used herein, Tg is an abbreviation for glass transition temperature. Primarily due to a combination of high boiling point, high latent heat of vaporization, high polarity, and strong hydrogen bonding of water, drying times of waterborne paints or coatings are generally longer than those exhibited by the organic solvent based coatings. The drying time strongly depends on the relative humidity of the atmosphere in which the coatings are applied. A waterborne paint may take several hours or more to dry in high humidity. The problem of retarded drying rate is especially aggravated for thick film (greater than about 500$\mu$) traffic markings. Long drying times severely limit the desirability of using waterborne paints, particularly traffic paints and road marking paints because of longer traffic disruptions.

In an attempt to produce waterborne coating compositions with shorter drying times, i.e., "fast-drying" coatings, methods utilizing salt, or acid, or combinations thereof to induce coagulation have been devised, as have pH sensitive binder systems.

EP-A-0066108 discloses an aqueous road marking composition in which the binder is a mixture of a pure acrylic resin, a carboxylated styrene/dibutyl fumarate copolymer and a polymeric, polyfunctional amine such as polypropylene imine. This application states that the disclosed compositions are not storage stable beyond 48 hours after which more polyfunctional amine must be added to restore activity. This low storage stability is unacceptable for most uses.

EP-B-0322188 discloses aqueous coating compositions comprising film forming latex polymer, weak base-functional synthetic latex polymer and volatile base. However, the weak base-functional polymer therein is water-insoluble as a consequence of crosslinking or high molecular weight. Such water-insolubility may cause the weak base moieties to be less readily available to interact with the latex polymer particles and the species (e.g., anionic surfactants) that stabilize them. This reduced availability may occur because a significant portion of the weak base moieties are buried beneath the surface of the water-insoluble particles or because insoluble particles are inherently limited in there ability to disperse their functionality uniformly within the coating composition.

EP-B-0409459 discloses an aqueous coating composition including an anionically stabilized emulsion polymer having Tg no lower than 0° C., a polyamine functional polymer, and a volatile base in an amount such that the composition has a pH where substantially all of the polyamine functional polymer is in a non-ionic state, and wherein more than 50% by weight of the polyamine functional polymer will be soluble at pH values of 5 to 7 on evaporation of the volatile base. In the non-ionic state (i.e., deprotonated), polyamine interaction with the anionically stabilized emulsion and any other anionic ingredients which may be present in the composition is eliminated. The volatile base must be volatile enough to be released under air drying conditions. In the absence of the volatile base, the protonated amine moieties interact with the anionic ingredients to destabilize the coating composition.

U.S. Pat. No. 5,804,627 discloses methods of producing fast drying coatings on exterior surfaces that include applying on those surfaces an aqueous composition including an anionically stabilized emulsion polymer having a Tg greater than about 0° C., a polyamine functional polymer having from about 20% to about 100% of the monomer units by weight containing an amine group, and an amount of volatile base sufficient to raise the pH of the composition to a point where essentially all of the polyamine functional polymer is in a non-ionic state, and evaporating the volatile base to produce the coating.

U.S. Pat. No. 5,922,398 discloses waterborne coating compositions containing latex particles having pendant amine-functional groups. The latex particles have Tg greater than about 0° C. and are capable of film formation at application temperatures. A amount of base (e.g., ammonia) is added to raise the pH of the composition to a point where essentially all of the amine functional groups are in a non-ionic state. Also disclosed are methods of producing fast drying coatings on suitable substrates by application of the coating compositions. Upon formation of a film, the base evaporates, allowing the pendant amine moieties to become protonated. The resultant pendant ammonium moieties then interact with anionic surfactants to destabilize the aqueous system and, thereby, speed drying.

U.S. Pat. No. 5,824,734 discloses a waterborne coating composition including an amine functional latex polymer having 0.1 to 5% by weight, based on solid weight of polymer, of a secondary or tertiary amino acrylate, a crosslinking monomer, and less than 5% by weight of hydrophilic monomers. The composition also includes mineral pigments. The amine functional latex polymer is prepared at pH of at least 7. Following polymerization, the pH is adjusted upward, preferably to between 8 and 9.5, to maintain the stability of the system. Upon reducing the pH, the stability of the dispersion of polymer particles and mineral pigment particles is decreased, leading to precipitation of the polymer and mineral particles and drying.

While all of the above mentioned patents represent improvements in drying speed for waterborne coating systems, still further reduced drying times are needed, particularly for thick film (i.e., thickness greater than 500 microns, particularly 1 to 3 millimeters, mm) traffic paints and traffic markings.

U.S. Pat. No. 5,947,632 discloses waterborne coating compositions including a number of general categories of materials including talc, hollow sphere polymer, a solid polymer (e.g., ion exchange resin beads in acid, sodium or potassium form) and inorganic compounds (e.g., inorganic superabsorbent gel, Sumica gel). These materials share the characteristic that they speed the drying of coatings when applied either in the same first step with the waterborne binder, or in a subsequent step. U.S. Pat. No. 5,947,632 also discloses incorporation of glass beads into the waterborne coating compositions. Glass beads impart retro-reflective characteristics to traffic paints and traffic markings, and can also serve as fillers for coating compositions. Other additives such as anti-skid material are also disclosed. While the coating compositions and methods of application to substrates of U.S. Pat. No. 5,947,632 provide shorter drying times, the methods of applying the materials that augment drying (e.g., ion exchange resin beads) result in coatings having surfaces from which those materials protrude. Although such protrusions can be desirable for glass beads due to enhancement of retro-reflection, protrusion of, for example, colored, or opaque ion exchange resin beads can cause reduction in such desirable characteristics as whiteness. Further, a portion of these absorber particles may bounce off, or otherwise disengage from, the coating before contributing fully, or partially, to accelerating the drying of the coating.

Throughout this document, the term "absorber" will be used to refer to the general class of materials that includes hollow sphere polymer, ion exchange resin beads (e.g., in acid form, in base form, in salt form, in partially neutralized form, or in mixed salt form), and absorbent inorganic compounds (e.g., inorganic superabsorbent gel, Sumica gel), including talc.

For a multi-component coating composition, we have unexpectedly discovered that when the absorber is applied in a step that precedes a step in which binder is applied, the surface of the dried coating (e.g., road marking) is smoother and drying times are shortened. In this regard, application of the multi-component coating composition to form "sandwich" structures is particularly efficient, and preferred. Used herein, the terms "sandwich" and "sandwich structure" refer to films formed by applying the absorber in a step that is preceded by at least one step of applying a binder containing composition, and that is followed by at least one step of applying a binder containing composition. This definition of "sandwich" and "sandwich structure" further extends to films formed by combining the first two steps above into a single step such that the absorber and binder are applied simultaneously, or nearly simultaneously, followed by applying a binder containing composition. We have further discovered unexpectedly that molecular sieves, non-porous carbonaceous materials, porous carbonaceous materials, and superabsorbent polymers (abbreviated SAP or SAPs herein) also speed the drying of coating compositions. These molecular sieves, non-porous carbonaceous materials, porous carbonaceous materials, and superabsorbent polymers will also be referred to herein as "absorbers".

The present invention relates to a method for preparing a fast drying multi-component waterborne coating on a surface of a substrate, the method including the sequential steps of:

a) applying component A including at least one water insoluble absorber to the surface of the substrate;

b) applying component B including a fast-drying binder composition to the surface of the substrate to which the water insoluble absorber has been applied; and c) allowing the multi-component waterborne coating to dry, wherein said absorber is selected from the group consisting of organic super absorbent polymers, ion-exchange resins, hollow sphere polymers, molecular sieves, talcs, inorganic absorbers, porous carbonaceous materials, non-porous carbonaceous materials, and mixtures thereof.

Another aspect of the present invention includes the additional sequential step of applying component C including a fast-drying binder composition to the surface of the substrate before applying component A water insoluble absorber and component B fast-drying binder composition, wherein component B is applied simultaneously or nearly simultaneously with component A, or in a subsequent step.

The present invention also relates to a method for preparing a fast drying multi-component waterborne coating on a surface of a substrate, the method including the sequential steps of:

a) applying component B including a fast-drying binder composition and glass beads to the surface of the substrate;

b) applying component A including at least one water insoluble absorber to the surface of the substrate to which component B has been applied; and c) allowing the multi-component waterborne coating to dry, wherein said absorber is selected from the group consisting of organic super absorbent polymers, ion-exchange resins, hollow sphere polymers, molecular sieves, talcs, inorganic absorbers, porous carbonaceous materials, non-porous carbonaceous materials, and mixtures thereof.

It is a still further aspect of the present invention that, in any of the methods of the present invention described supra, a fast-drying binder composition may include, but not be limited to, any of the following [(I) through (VII)]:

I) An Aqueous Dispersion Including:

(i) anionically stabilized polymer having Tg of greater than −10° C.;

(ii) polyamine functional polymer; and (iii) volatile base in an amount sufficient to deprotonate the conjugate acid of said polyamine functional polymer;

II) An Aqueous Dispersion Including:

(i) a polyamine functional polymer that is a latex polymer having pendant amine-functional groups, wherein such latex polymer has a Tg equal to or greater than −10° C.; and (ii) volatile base in an amount sufficient to deprotonate the conjugate acid of said polyamine functional polymer;

III) An Aqueous Dispersion Including:

(i) a polyamine functional polymer that is a latex polymer having pendant amine-functional groups and pendant acid-functional groups, wherein the ratio of amine-functional groups to acid-functional groups is greater than 3 to 1, and wherein said latex polymer has a Tg equal to or greater than −10° C.; and (ii) volatile base in an amount sufficient to deprotonate the conjugate acid of said polyamine functional polymer;

IV) An Aqueous Dispersion Including:

(i) a polyamine functional polymer that is a latex polymer having pendant amine-functional groups, wherein said latex polymer having pendant amine-functional groups has a Tg equal to or greater than −10° C.;

(ii) a latex polymer having pendant acid-functional groups, wherein said latex polymer having acid-functional groups has a Tg equal to or greater than −10° C.; and (iii) volatile base in an amount sufficient to deprotonate the conjugate acid of said polyamine functional polymer;

V) An Aqueous Dispersion Including:

(i) an aqueous emulsion containing a polyamine functional polymer, having a Tg equal to or greater than −10° C., formed from polymerizable monomers including:

(a) alkyl esters of acrylic or methacrylic acid having an alkyl ester portion containing between 1 to 18 carbon atoms;

(b) from 0.1 to 5% by weight, based on said acrylic film forming polymer, of a at least one secondary or tertiary aminoacrylate monomer, or secondary or tertiary aminomethacrylate monomer; and (c) from 0.1 to 5% by weight, based on said acrylic film forming of crosslinkable monomer selected from the group consisting of acrylamide, methacrylamide, and N-alkylol acrylamide; and said polyamine functional polymer having less than 3 percent by weight, based on said film forming polymer of hydrophilic monomer incorporated therein; and (ii) volatile base in an amount sufficient to deprotonate the conjugate acid of said polyamine functional polymer;

VI)

(i): an aqueous dispersion including: polymer having pendant strong cationic groups, wherein said polymer having pendant strong cationic groups has a Tg equal to or greater than −0° C.; and (ii): an aqueous dispersion including: polymer having pendant weak acid groups, wherein said polymer having pendant weak acid groups has a Tg equal to or greater than −10° C.; and wherein aqueous dispersion (i) and aqueous dispersion (ii) may be applied to said surface of a substrate in any order as part of said fast drying binder composition; and VII) An Aqueous Dispersion Including:

(i) polymer having both pendant strong cationic groups and pendant weak acid groups, wherein said polymer has a Tg equal to or greater than −10° C.; and wherein it is a necessary condition that said surface of a substrate is, or is treated to be, sufficiently basic that said aqueous dispersion sets in less time than the time required for a latex that only contains pendant strong cation groups, or pendant weak acid groups, to set.

In a still further aspect of the present invention, glass beads are included with any of components A, B, and C in any of the steps of applying those components or in a separate step preceding, between, or following the steps of applying components A, B, and C.

Among the ion exchange resins of the present invention are those having acid functionality selected from the group consisting of sulfonate, carboxylate, phosphonate, aminophosphonate, their salts, and mixtures thereof. Ion exchange resins of the present invention further include those that are transparent or translucent.

Among the organic super absorbent polymers of the present invention are those prepared from at least one monomer selected from the group consisting of acrylic monomer, methacrylic monomer, and mixtures thereof The present invention includes a further step of applying an aqueous solution which comprises a substance selected from the groups consisting of acids, water soluble salts, and mixtures thereof, wherein the acid is selected from the group consisting of acetic acid, citric acid and mixtures thereof.

Multiple coat systems are also an aspect of the present invention. Used herein, "multiple coat system" refers to combinations of any of the series of application steps explicitly described herein. For example, sequential steps of application of C, A, and B could be followed by sequential steps of application of A, B and G.

The present invention also includes the composites formed by any of the methods of the invention. The multi-component waterborne coating of the present invention can, specifically, be a multi-component waterborne road marking paint.

The present invention can be used in many coating, painting or marking applications. For instance, the method and composition of the present invention can be used for traffic paints, road markings, house paints, maintenance coatings for exterior or interior surfaces of buildings, walls, roofs, and other structures. The surface of the substrate may be wood, metal (such as aluminum, steel and others) polymers, plaster and others. Other applications include coating metal substrates present in a wide variety of manufactured articles such as signs, boats, cars, etc. All of the substrates may already have one or more layers of existing coating or paint which may be fresh or aged.

The present invention is also useful for improving the drying rate of thick-film coatings or markings. The present invention may be used for accelerating the drying of fresh thick film waterborne paint formulations, which contain 87–93 wt % total solids, in order to enable films of thickness 1 mm and greate, typically from 1 mm up to 3 mm, to be painted. Because of their relatively substantial thickness, such films dry fairly slowly despite the use of quick-drying binder systems, such as those disclosed in EP-B-0322188 and EP-A-409459, both of which are described supra.

It is generally desirable to have additional components added to the coating composition to form the final formulation for traffic paints or other coatings described herein. These additional components include, but are not limited to, thickeners; rheology modifiers; dyes; sequestering agents; biocides; dispersants; pigments, such as, titanium dioxide, organic pigments, carbon black; extenders, such as, calcium carbonate, talc, clays, silicas and silicates; fillers, such as glass or polymeric microspheres, quartz and sand; antifreeze agents; plasticizers; adhesion promoters such as silanes; coalescents; wetting agents; surfactants; slip additives; crosslinking agents; defoamers; colorants; tackifiers; waxes; preservatives; freeze/thaw protectors; corrosion inhibitors; and anti-flocculants.

The term "road" is used herein as a generic term and it includes any indoor or outdoor solid surface which is or may be exposed to pedestrians, moving vehicles, tractors, or aircrafts continuously, constantly or intermittently. Some non-limiting examples of a "road" include highways, streets, driveways, sidewalks, runways, taxiing areas, tarmac areas, parking lots, rooftops, indoor floors (such as factory floors, inside a shopping mall, etc), and others. The surface material may be masonry, tar, asphalt, resins, concrete, cement, stone, stucco, tiles, wood, polymeric materials and combinations thereof. It is also within the scope of the invention to apply such a two- or multi-component waterborne coating over another one or more layers of fresh or aged coating or marking already applied on the surface.

The terms "fast drying", "rapid drying", "quick drying", "faster drying", "fast drying property", "increased drying rate" and "accelerated drying" are used interchangeably herein to mean that a film of a so designated coating composition having a wet coating thickness of up to 330 microns displays a dry-through time of less than one and one-half hours at 90 percent relative humidity at 23° C. when applied without inclusion of absorbers. It is also within the present invention that addition of an absorber to the fast drying coating composition in accordance with the disclosure further reduces the drying time.

In the present invention, accelerated drying may occur on the surface of the film, partially or throughout the depth of the film, or combinations thereof. The increased drying rate can be observed or determined by analyzing and/or measuring the surface dry time, or dry-to-touch time, or dry-to-no-pickup time, the dry-through time, the water-resistance or rain-resistance and other properties of the freshly applied paint. ASTM test methods are useful for determining drying rates. Especially useful is ASTM Method D 1640 directed at "Test methods for drying, curing, or film formation of organic coatings at room temperature". Also useful are the test methods defined herein below for Examples 1–26.

Fast-drying binder compositions useful as part of the fast drying multi-component waterborne coatings of the present invention include solvent-based systems. For example, carbonaceous absorbers such as Ambersorb® are capable of absorbing solvent upon addition to solvent based coating systems, resulting in acceleration of drying. Useful fast-drying binder compositions also include several types of fast drying waterborne binder compositions. Some of these fast-drying binder compositions are described in the next paragraphs. Although the present invention is applicable to all of the fast drying binder compositions described herein, it is not limited to them, but rather is general for any fast drying binder composition and the fast drying multi-component waterborne coatings incorporating them.

Used herein, the term "polyamine functional polymer" refers to polymers bearing amine functional moieties either pendant to the polymer backbone or as an integral part of the backbone, or a combination of both pendant and backbone amine groups. As noted herein below, these polyamine functional polymers can be prepared from amine monomers, imine monomers, and monomers bearing functionality that can be converted to amine functionality.

Certain of the fast-drying compositions described in the next paragraphs have Tg (glass transition temperature) ranges for the binder polymer that are somewhat narrower than the range −10° C. to 70° C. disclosed for the binder polymers of the present invention. Such narrowed Tg ranges should in no way be construed as limiting the present invention. Any of these fast drying coating compositions may be prepared such that they contain binder polymer having Tg as low as −10° C. and as high as 70° C.

EP-B-0409459 discloses a fast drying aqueous coating composition including an anionically stabilized emulsion polymer having Tg no lower than 0° C., a polyamine functional polymer, and a volatile base in an amount such that the composition has a pH where substantially all of the polyamine functional polymer is in a non-ionic state, and wherein more than 50% by weight of the polyamine functional polymer will be soluble at pH values of 5 to 7 on evaporation of the volatile base. In the non-ionic state (i.e., deprotonated), polyamine interaction with the anionically stabilized emulsion and any other anionic ingredients which may be present in the composition is eliminated. The volatile base must be volatile enough to be released under air drying conditions. During film formation, the volatile base evaporates with the result that the amine moieties of the polyamine functional polymer become protonated to form ammonium moieties which, in turn, interact with the anionic ingredients to destabilize the coating composition and thereby accelerate drying.

WO 96/22338 discloses a fast drying aqueous coating composition including from 95 to 99 weight percent of an anionically stabilized aqueous emulsion of a copolymer having a Tg of from −10° C. to 5° C., the copolymer containing two or more ethylenically unsaturated monomers, wherein from 0 to 5 weight percent of the monomers are a,b-ethylenically unsaturated aliphatic carboxylic acid monomers; from 0.2 to 5 weight percent of a polyimine having a molecular weight of from 250 to 20,000; and from 0.2 to 5 weight percent of a volatile base, wherein the composition has a pH from 8 to 11, and wherein a cast film of the composition loses the volatile base by evaporation to accelerate drying. The term "polyimine", used in the context of WO 96/22338, indicates that the polymer was prepared using imine monomers (e.g., ethyleneimine). The resultant polymer contains no imine functionality. Instead, the polymer contains amine functionality as part of the polymer backbone. It is this polyamine functional polymer that is deprotonated in the presence of volatile base. Upon formation of a film from the aqueous coating composition, the volatile base is released, allowing the amine moieties in the polymer backbone to protonate.

U.S. Pat. No. 5,922,398 discloses aqueous coating compositions containing a latex having pendant amine-functional groups, wherein such latex has a Tg equal to or greater than 0° C. and is capable of film formation at application temperatures, and an amount of base sufficient to raise the pH of the composition to a point where essentially all of the amine functional groups are in a non-ionic state. The amine-functionalized latexes have a number average molecular weights in the range of 1,000 to 1,000,000 and particle sizes that vary between 20 and 1000 nanometers. These latexes may be in the form of single, or multi-staged particles. The multi-staged particles include at least two mutually incompatible copolymers having any of a wide variety of morphologies, including core/shell, interpenetrating network, and multiple core. The latex polymer may also contain acid-functional moieties. When acid-function moieties are present, the weight ratio of amine-functional moieties to acid-functional moieties is generally at least 3 to 1. Both amine-functional moieties and acid-functional moieties may be incorporated into the same latex particle or into separate latex particles. Amine functional monomers polymerized to prepare amine-functional latex particles are used at a level of at least 2 percent by weight, based on total monomers. Acid functional monomers polymerized to prepare acid-functional latex particles are used at a level that is usually less than 10 percent by weight, based on total monomers. Latex particles are stabilized by surfactants, including anionic and non-ionic emulsifiers. The coating compositions of U.S. Pat. No. 5,922,398 use volatile base (e.g., ammonia) to stabilize the amine-functional moieties of the latex particles against interaction with surfactants during storage and application of films. Once applied, the films lose volatile base by evaporation, the amine-functional particles protonate to become ammonium-functional particles which, in turn, interact with surfactant, causing destabilization of the latex particles and acceleration of drying.

U.S. Pat. No. 5,824,734 discloses an improved fast drying coating composition particularly adapted for use as a traffic paint. This basic waterborne coating for traffic paint includes an aqueous emulsion containing an acrylic film forming polymer, a stabilizing system for the emulsion which is pH sensitive, and mineral pigment. The acrylic film forming polymer is a hydrophobic acrylate containing polymer. The hydrophobic monomers polymerized to produce the hydrophobic acrylate containing polymer include alkyl esters of acrylic or methacrylic acid having an alkyl ester portion containing between 1 to 12 carbon atoms. The hydrophobic acrylate containing polymer further incorporates from about 0.1 to 5% by weight of a secondary or tertiary amino acrylate and 0.1 to 5% by weight of crosslinkable monomers, such as N-alkylol acrylamides and N-alkylol methacrylamides, both weight percents based on total weight of polymer. The hydrophobic acrylate containing polymer should further contain less than 5 weight percent of hydrophilic monomers, based on total polymer. The aqueous dispersion is typically stabilized by a combination of anionic and non-ionic surfactants, and is pH sensitive. The pH is maintained above 7, preferably by addition of a volatile base like ammonia, until application of the coating onto a surface. Loss of base then effects collapse of the emulsion and the water is exuded from the amide- or amine-functional acrylate containing film forming hydrophobic polymer.

WO 98/52698 discloses a coating material including a substrate having a surface and a coating thereupon, wherein the coating is prepared by: a) contacting the surface of the substrate with a stable aqueous dispersion that contains a polymer having pendant strong cationic groups, and pendant weak acid groups; or b) contacting the surface of the substrate with a stable aqueous dispersion that contains a first polymer having pendant strong cationic groups, and a stable aqueous dispersion of a second polymer having pendant weak acid groups, the contact of the polymers with the surface being made in any order, or concurrently. When the stable aqueous dispersion contains a polymer having pendant strong cationic groups and pendant weak acid groups (i.e., coating "a" of WO 98/52698), it is a necessary condition that the surface of the substrate is, or is treated to be, sufficiently basic that the stable aqueous dispersion sets in less time than the time required for a latex that only contains pendant strong cation groups, or pendant weak acid groups, to set. The cationic groups are, for example, quaternary ammonium moieties, while the weak acid groups are, for example, carboxylic acid moieties. When coating "a" contacts the basic surface of the substrate, the base removes the proton from the weak acid, producing an anionic species that interacts with the cationic moiety to form crosslinks, destabilize the dispersion, and accelerate drying of the film. Cationic surfactants present in the aqueous dispersion are also rendered inactive by interaction with the anions generated from the weak acid groups. When coating "b" of WO 98/52698 is applied to a substrate, there is no requirement that the substrate be basic because one dispersion is cationically stabilized and the other is anionically stabilized such that, upon mixing, the oppositely charged surfactants interact to inactivate one another. Further, because the weak acid functional latex particles are anionically stabilized in coating "b", it is possible to adjust the pH of the aqueous dispersion such that the weak acid moieties are deprotonated and available to interact with cationic species upon film formation. The various routes to destabilization are possible contributors to accelerated drying of films.

Preferred binders to be used in a paint composition for the present invention are anionically stabilized polymers. These binders can be prepared by a number processes such as those described in "*Emulsion Polymerization of Acrylic Monomers*" published by Rohm and Haas Company, May 1966. Many of these binders have been described in U.S. Pat. No. 5,820,993, U.S. Pat. No. 5,804,627; U.S. Pat. No. 5,672,379; and U.S. Pat. No. RE 36,032. Anionically stabilized polymer particles can, for example, be prepared from a wide range of acrylic and methacrylic monomers. isobornyl (meth) acrylate, isodecyl (meth)acrylate, oleyl (meth)acrylate, palmityl (meth)acrylate, stearyl (meth)acrylate, 2-hydroxyethyl (meth)acrylate, 3-hydroxypropyl (meth) acrylate, 4-hydroxybutyl (meth)acrylate, glycidyl (meth) acrylate; acid functional monomers, such as, acrylic acid, methacrylic acid, crotonic acid, itaconic acid, fumaric acid and maleic acid; monomethyl itaconate; monomethyl fumarate; monobutyl fumarate; maleic anhydride; acrylamide or substituted acrylamides; (meth)acrylonitrile; sodium vinyl sulfonate; phosphoethyl(meth)acrylate; acrylamido propane sulfonate; diacetone acrylamide; acetoacetylethyl methacrylate; acrolein and methacrolein; dicyclopentadienyl methacrylate; dimethyl meta-isopropenylbenzyl isocyanate; isocyanatoethyl methacrylate; styrene or substituted styrenes; butadiene; ethylene; vinyl acetate or other vinyl esters; vinyl monomers, such as, for example, vinyl halide, preferably vinyl chloride, vinylidene halide, preferably vinylidene chloride, N-vinyl pyrrolidone; amino monomers, such as, for example, N,N'-dimethylaminoethyl (meth)acrylate, N,N'-dimethylaminopropyl methacrylamide, and oxazolidinoethyl methacrylate. When used herein, the word fragment "(meth)acryl" refers to both "methacryl" and "acryl". For example, (meth)acrylic acid refers to both methacrylic acid and acrylic acid, and methyl (meth)acrylate refers to both methyl methacrylate and methyl acrylate.

The first compositional type of component B binder includes at least one polymer selected from the group consisting of polyamine functional polymers. Polyamine functional polymers useful in the present invention may be prepared by a number of methods. They may be made by (a) polymerization or co-polymerization from at least one amine-functional-group-containing monomer with other monomers as described above; or (b) polymerization or co-polymerization from at least one monomer which contains a functional group transformable into an amine functional group after the (co)polymerization reaction. U.S. Pat. No. 5,672,379 describes preparation of traffic paint compositions having low molecular weight latex polymer as binder, wherein the latex polymer used in the composition is modified with acetoacetyl functional pendant moiety and amino silane to improve wear characteristics. The amino silane molecules can either react with the acetoacetyl moiety for form a pendant amino group, or they can react with each other to form a polyamine function polymer. U.S. Pat. No. 5,824,734 discloses traffic paints utilizing a hydrophobic acrylate containing polymer which incorporates from about 0.1 to 5% by weight of polymer of a secondary or tertiary amino acrylate and a crosslinkable monomer as components of the hydrophobic polymer. Useful methods of producing amine functional polymers include addition polymerization of ethylenically unsaturated monomers containing amine-functionality; polymerization of monomers which readily generate amines by hydrolysis or other reactions; reactions of imine monomers (e.g., alkylene imines); reactions of aziridines with carboxyl-containing polymers; reactions of polymers containing an enolic carbonyl group, e.g., acetoacetoxyethyl methacrylate with diamines; reactions of amines with epoxy-containing polymers; and reactions of amine with polymers of vinyl benzyl chloride.

Many monomers may be polymerized to form polyamine functional polymers. Examples of such monomers include aminoalkyl vinyl ethers, aminoalkyl vinyl sulfides, (meth) acrylamides, (meth)acrylic esters containing amine functional groups, N-acryloxyalkyltetrahydro–1,3-oxazines and N-acryloxyalkyloxazolidines. More specific examples are those disclosed in U.S. Pat. No. 5,804,627, column 3, line 52 to column 6, line 26. The preparation method is the same as that disclosed in U.S. Pat. No. 5,804,627, column 6, lines 27–59. Polyamine functional polymers include, for example, polymers formed by polymerization of imines. Such polymers are sometimes referred to as polyimines. Polyimines may, for example, be prepared from ethylene imine, propylene imine or other similar monomers. The name "polyimine" denotes that the polymer was formed from imine monomers, not that the resultant polymer contains imine functionality. This is an very important distinction, because polyimines do contain amine functionality in their backbones and, as such, are simply another type of polyamine functional polymer.

When component B or C binder includes a polyamine functional polymer, it will further include a volatile base in an amount sufficient to deprotonate the conjugate acid of the polyamine functional polymer. For example, the conjugate acid of a dialkylamino group would be a dialkyl ammonium group. Low molecular weight alkylamines and ammonia (or its aqueous form—ammonium hydroxide) are examples of volatile bases. Alkyl amines that fall within this category include methyl amine, dimethyl amine, trimethyl amine, ethyl amine, methyl ethyl amine, diethyl amine, triethyl amine, ethanol amine, diethyl hydroxyl amine, ethylene diamine, and mixtures thereof. A number of higher molecular weight, and/or less volatile, amines also may be used. Examples include morpholine, piperazine, cyclohexylamine, aniline, pyridine, mixtures thereof, and mixtures thereof with other alkylamines or ammonia. It is preferred to use a base or a base mixture which is relatively volatile or has a relatively high vapor pressure, viz greater than 5 kPa, preferably greater than 20 kPa, at a temperature in the range of 0° C. to 50° C. Ammonia (or its aqueous equivalent—ammonium hydroxide existing in a range of concentrations in water) is a preferred base when a volatile base is used.

When an anionically stabilized polyamine functional binder polymer, or a polyamine functional polymer and an anionically stabilized binder polymer, are included in the binder system, the volatile base or base mixture may be incorporated in a wide range of concentrations, from 0.01 wt % to 75 wt %, based on the total weight of the binder present. A preferred concentration is in the range of from 0.1 wt % to 60 wt %, more preferred in the range of from 1 wt % to 50 wt %, all based on the total weight of the binder present in component B or C.

A preferred pH of the first compositional type of component B binder is in the range of from 7.5 to 11.5, more preferred from 8.5 to 11. This pH may be obtained or achieved by using many different reagents or methods. One example is to add base, which may be organic, inorganic, or mixtures thereof, to the component to adjust the pH to the desired level.

Absorbers suitable for use in component A of the present invention are preferably water insoluble. However, it is possible for an absorber of the present invention to be effective even if a portion of that absorber is susceptible to dissolution upon addition to the aqueous system. "Water insoluble" is defined herein as having a solubility of less than 0.5 grams of the absorber per 100 grams of water at 20° C. More preferably, the solubility is less than 0.1 gram of the absorber per 100 grams of water at 20° C., and most preferably the solubility is less than 0.05 gram of the absorber per 100 grams of water at 20° C.

Many absorbers having liquid or gas absorption or adsorption properties may be used for the present invention. The absorbers should be able to adsorb and/or absorb small polar molecules like water, ammonia, $C_1$–$C_6$ alkyl amines, $C_1$–$C_6$ alkyl alcohols, or a combination thereof. It is preferred that an absorber is has a substantial number of polar sites per gram of absorber or per square meter of surface area and these polar sites can interact or react with small polar molecules such as water, ammonia, $C_1$–$C_6$ alkyl alcohols, $C_1$–$C_6$ alkyl amines, and mixtures thereof. Examples of absorbers include organic super absorbent polymers, ion-exchange resins, hollow sphere polymers, molecular sieves, inorganic absorbents, porous carbonaceous materials, non-porous carbonaceous materials, and mixtures thereof. Not all such materials may be used for all applications. For example, where light color in the application is desired, carbonaceous materials may not be suitable in all instances because they are black.

The particle size of an absorber should be in the range of from 0.05 $\mu$ to 5000 $\mu$, preferably in the range of 10 $\mu$ to 1500 $\mu$, where $\mu$ denotes micron. In general, uniform distributions of all the solid components, including the absorber, are preferred.

The amount of an absorber or a mixture of absorbers used in the present invention is in the range of from 0.01 wt % to 90 wt %, based on the total weight of the two- or multi-component coating composition. A preferred range is from 0.1 wt % to 70 wt %, more preferably from 1 wt % to 30 wt %. Key parameters to be considered in determining the amount of an absorber to be used include: the amount of the binder, the type of the binder, the water content, the type of absorber, the properties of the absorber, the desired thickness of the film, the paint application conditions (temperature, relative humidity, substrate, history of substrate surface, and combinations thereof), and other ingredients present in the final composition of the paint formulation, and a combination thereof.

Many ion exchange resins (IERs) in the acid or metal ion form may be used. The term "ion exchange resin" is used interchangeably with "IER" herein. These cationic IERs include polymer or copolymer backbones bearing one or more acid functional groups. The acid functional groups may be present in the monomer(s) used and/or they may be generated after polymerization or copolymerization is completed. Crosslinked polymers are preferred. For the present invention, a preferred IER comprises either a strong acid cation exchange resin or a weak acid cation exchange resin. Mixtures of IERs also may be used.

Examples of suitable IER(s) include organic ion exchange resins having sulfonic acid groups (—$SO_3H$, sulfonate functionality), carboxylic acid groups (—COOH, carboxylate functionality), iminodiacetate groups, phosphonic acid groups (—$PO(OH)_2$, phosphonate functionality), alkylaminophosphonic acid groups (aminophosphonate functionality, such as —$NR^1CH_2PO(OH)_2$ where $R^1$ is methyl, ethyl, etc.) and mixtures thereof. Most of the polymers mentioned so far are based on polystyrene or crosslinked polystyrene backbone structures. Crosslinked polyacrylic acid or polymethacrylic acid polymers may be used too. They are weakly acidic. Sulfonic acid groups are generally strong acid groups. Carboxylic-acid-group and sulfonic-acid-group containing IERs are preferred.

The counter ions (cations) to the acid functional group include $H^+$, $Li^+$, $Na^+$, $K^+$, $Rb^+$, $Cs^+$, $NH_4^+$, $Be^{++}$, $Mg^{++}$, $Ca^{++}$, $Sr^{++}$, $Ba^{++}$, $Zn^{++}$, $Al^{+++}$and mixtures thereof Organic ammonium cations also may be used. Examples include $R^1R^2R^3R^4N^+$where the R's are independently selected from $C_1$–$C_{12}$ alkyl groups, phenyl, substituted phenyl groups, aryl groups and substituted aryl groups, such as $(CH_3)_4N^+$, $(C_2H_5)_4N^+$and mixtures thereof Examples of commercially available IER's which can be used for the present invention include: AMBERLYST® 15, AMBERLYST® 131 PDry, AMBERJET® IR-120H, AMBERLITE® IRC-84, AMBERLITE® IRC-84SP, AMBERLITE® IRC-96K, AMBERLITE® IRP-64, AMBERLITE® IRP-69, AMBERLITE® XE-64W, AMBERJET® 1200H, AMBERJET® HP1110Na, NAFION® NR50, and mixtures thereof.

The polymer or copolymer backbone of an ion exchange resin is prepared by polymerizing a monomer or co-polymerizing a mixture of monomers. If the acid functional group is not present in at least one of the monomers present, at least one of the monomers must be susceptible to post-polymerization functionalization. One or more of the monomers present also serve as a crosslinking monomer to impart desired physical/chemical properties. Many such properties depend on the degree of polymerization, post-polymerization functionalization conditions, degree of functionalization, and others. In general, lighter colored translucent or opaque IER's are preferred. However, more highly colored IERs may be used where they are incorporated into multilayer, sandwich structures created, for example, by both preceding and following an IER application step with binder application steps.

Some IER's are translucent. This may be a desirable property. For example, if a some of these lighter colored translucent IERs are visible on the surface of the finished coating, light reflective properties can be enhanced. Thus, translucent IERs may either augment the reflective properties of glass beads used in traffic markings or reduce the amount of glass beads needed, thus reducing the overall cost of applying the paint.

It was also discovered that a "used" or "spent" ion exchange resin may exhibit the same or similar useful absorption characteristics as a new, or fresh, IER when substituted for that new, or fresh, IER. The terms "used" and "spent" are used interchangeably herein to mean a resin has been previously used in other applications or exposed to other chemical reaction conditions. For example, an acid resin such AMBERLYST® 15 which has been previously used as a catalyst in an ether synthesis reaction (such as synthesis of methyl t-butyl ether [MTBE] from methanol and isobutene) may be as effective, or nearly as effective, in the present invention as fresh AMBERLYST® 15. Similarly, an IER may have been used for other ion-exchange uses. In general, the cost of a used IER is expected to be much lower than that of a fresh IER.

IERs may also provide additional benefits such as anti-skid provided that they are used in the quantities and have the particle sizes as disclosed herein.

IER beads may be applied in dry form or they may contain water at levels as high as 95% by weight, based on total combined weight of the IER solids and the water contained in the IER. The preferred water content is 0 to 40%.

It is also within the scope of the present invention to use a mixture of different resins of the same structure type (different gellular resins or different macroporous types) or different types (one or more gellular types with one or more macroporous types). An example of a gellular IER is AMBERLITE® IRC-84SP and an example of a macroporous IER is AMBERLITE® IRC-64.

Absorbers can also be organic superabsorbing polymers (SAPs). The water-absorbent resins of this class heretofore known to the art include partially neutralized crosslinked polyacrylic acids (JP-A-55-84,304, JP-A-55-108,407, JP-A-55-133,413, U.S. Pat. No. 4,654,039, and U.S. Pat. No. 4,286,082), hydrolyzed star acrylonitrile graft polymers (JP-A-46-43,995 and U.S. Pat. No. 3,661,815), neutralized starch-acrylic acid graft polymers (JP-A-51-125,468 and U.S. Pat. No. 4,076,663), saponified vinyl acetate-acrylic ester copolymers (JP-A-52-14,689 and U.S. Pat. No. 4,124,748), hydrolyzed acrylonitrile copolymers or acrylamide copolymers (JP-A-53-15,959, U.S. Pat. No. 3,935,099 and U.S. Pat. No. 3,959,569), crosslinked derivatives thereof, crosslinked carboxymethyl cellulose (U.S. Pat. No. 4,650,716 and U.S. Pat. No. 4,689,408, and crosslinked polymer of cationic monomers (JP-A-58-154,709, JP-A-58-154,710, U.S. Pat. No. 4,906,717, U.S. Pat. No. 5,075,399, and EP 0304,143), crosslinked isobutylene-maleic anhydride copolymers (U.S. Pat. No. 4,389,513), and crosslinked copolymers of 2-acrylamide-2-methylpropanesulfonic acid with acrylic acid (EP 068,189), for example.

Suitable organic super absorbent polymers (SAP's) include polymers prepared from at least one monomer selected from the group consisting of an acrylic monomer, a methacrylic monomer and mixtures thereof, and derivatives such as salts of such polymers. Examples are partially neutralized crosslinked polyacrylic acids, hydrolyzed starch-acrylonitrile graft polymers, neutralized starch-acrylic acid graft polymers, saponified vinyl acetate-acrylic ester copolymers, hydrolyzed acrylonitrile copolymers or acrylamide copolymers, crosslinked derivatives thereof, crosslinked carboxymethyl cellulose, crosslinked polymers of cationic monomers, crosslinked i-butylene-maleic anhydride copolymers, crosslinked copolymers of 2-acrylamide-2-methylpropanesulfonic acid with acrylic acid, and mixtures thereof. The neutralization or partial neutralization may be achieved by reacting a suitable SAP with a base such as sodium hydroxide, potassium hydroxide, ammonium hydroxide, and others.

U.S. Patent No. 5,075,399 discloses SAPs that are copolymers of ampholytic ion pair monomers and acrylic comonomers including acrylamide, methacrylamide, acrylic acid, methacrylic acid, salts of acrylic acid, and salts of methacrylic acid. The ampholytic ion pair monomers are, for example, combinations of the ammonium cation 2-methacryloyloxyethyltrimethylammonium and an anion selected from the group consisting of 2-acrylamido-2-methylpropane sulfonate, 2-methacryloyloxyethane sulfonate, vinyl sulfonate, styrene sulfonate and combinations thereof.

U.S. Patent No. 4,654,039 discloses SAPs that are hydrogel-forming polymer compositions. These SAPs are substantially water-insoluble, slightly crosslinked, partially neutralized polymers prepared from unsaturated polymerizable, acid group-containing monomer and crosslinking agents.

U.S. Pat. No. 4,909,717 discloses water absorbing resin based on acrylic acid and on dialkylaminoalkyl acrylate. The SAP resin includes from 40 to 60% on a molar basis of acrylic acid, all or part of which is in salt form, and 60 to 40% on a molar basis of at least one dialkylaminoalkyl acrylate at least partially in salt form, or quaternized. The SAP resin is polymerized in aqueous solution or inverse emulsion in the presence of at least one free-radical initiator.

Crosslinked polymers and copolymers made from acrylic or methacrylic monomers, particularly acrylic acid and/or methacrylic acid are preferred SAP's. Examples of such monomers include acrylic acid, methacrylic acid, methyl acrylate, methyl methacrylate, and other acrylate and methacrylate esters having $C_2$ to $C_{20}$ alkyl groups. The polymers or copolymers are usually in the carboxylic acid form(—COOH), or completely or partially converted to the carboxylic acid form if ester monomers are used. In addition, as mentioned herein above, some or all of the carboxylic acid functional groups (—COOH) may be neutralized with a metal ion or a base having a cation such as $NH_4^+$, $Li^+$, $Na^+$, $K^+$, $Rb^+$, $Cs^+$, $Be^{++}$, $Mg^{++}$, $Ca^{++}$, $Sr^{++}$, $Ba^{++}$, $Zn^{++}$, $Al^{+++}$and mixtures thereof. Organic ammonium cations also may be used. Examples include $R^1R^2R^3R^4N^+$where the R's are independently selected from $C_1$–$C_{12}$ alkyl groups, phenyl, substituted phenyl groups, aryl groups and substituted aryl groups, such as $(CH_3)_4N^+$, $(C_2H_5)_4N^+$and mixtures thereof. Examples of commercially available SAP materials include AQUALIC® CA (Nippon Shokubai Kagaku Kogyo Co., Ltd.). SAP's in both fibrous and particular forms may be used. SAP's in particulate form (as particles) are preferred. The range of suitable particle size is discussed elsewhere herein.

Yet another type of absorber includes materials like AMBERSORB®, activated carbons, carbon blacks, pyrolyzed polyacrylonitrile or other types of carbonaceous materials. AMBERSORB® is a registered trademark of Rohm and Haas Company.

Molecular sieves, including many natural and synthetic zeolites which have liquid or gas absorption and/or adsorption properties, may be used as the absorber for the present invention. Synthetic zeolites are generally white and natural zeolites may be white, off-white, or colored. Off-white or colored molecular sieves or zeolites may be limited to applications where color of the coating is compatible or not important. Examples of molecular sieves include metal-containing or acid form zeolite or molecular sieve such as 3A, 4A, 5A, 10X, 13X, Y, ZSM-5, ZSM-11, beta, faujasite, erionite, SAPO-5, SAPO-11, SAPO-34, ALPO-5, and mixtures thereof While the more hydrophobic type zeolites or silicas such as silicalite or high Si/Al atomic ratio (greater than 100) ZSM-5 may be used, they are not particularly preferred for the present invention.

Other inorganic materials such as aluminas, silica-aluminas or their mixtures also may be used alone or in conjunction with other disclosed absorbers. Examples include aluminas such as α-alumina, γ-alumina, θ-alumina, η-alumina, amorphous silica-aluminas, crystalline silica-aluminas, diatomaceous earth (such as CELITE® or kieselguhr), and mixtures thereof. Materials like kieselguhr also have been known to be useful as extenders by forming a mixture with the binder prior to application of the paint. Magnesium silicates such as talc may also be used as absorbers.

The molecular sieves and other inorganic materials are available from a number of companies, including Mobil, Union Carbide, W. R. Grace, Aldrich, Johnson Matthey, and others.

Hollow sphere polymer particles are also useful as absorbers in the present invention. The hollow sphere polymer particles are also referred to herein as voided latex particles. The voided latex particles useful in the method of the invention have a particle size of 50 nm to 2,000 nm and a void fraction of 10% to 75%. The voided latex particles useful in the method of the invention have a particle size of, preferably, 50 nm to 1,100 nm, and, more preferably , 50 to 700 nm. Preferably, the voided latex particles useful in the method of the invention have a single void. The particle size and void fraction of the voided latex particles may be determined by conventional techniques known in the art, including microscopy and the Brookhaven Model BI-90 Particle Sizer supplied by Brookhaven Instruments Corporation, Holtsville, N.Y., which employs a quasi-elastic light scattering technique to measure the size of the particles.

The voided latex particles useful in the method of the invention have a glass transition temperature, as measured by differential scanning calorimetry at a rate of 20° C., of at least 20° C. and, more preferably, of at least 50° C. A higher glass transition temperature contributes to a harder particle that is less likely to collapse during storage prior to use.

The voided latex particles useful in the invention may be prepared by conventional polymerization processes known in the art, such as those disclosed in U.S. Pat. Nos. 3,784,391; 4,798,691; 4,908,271; 4,972,000; published European Patent Application 0,915,108; and Japanese Patent Applications 60/223,873; 61/62510; 61/66710; 61/86941; 62/127336; 62/156387; 01/185311; 02/140272. Preferably, the voided latex particles are prepared according to U.S. Pat. Nos. 4,427,836; 4,469,825; 4,594,363, 4,880,842 and 5,494,971 and published European Patent Application 0,915,108. Voided latex particles, such as ROPAQUE® OP–62, are available from Rohm and Haas Company of Philadelphia, Pa.

Glass beads, quartz beads, ceramic beads and mixtures thereof are collectively referred to herein as "glass beads" or "G". Glass beads may be included in one or more of components A, B, and C of the present invention. Glass beads may also be applied in one or more separate steps as component D of the present invention. A primary function of the glass beads is to provide reflective properties to traffic paints or road marking coatings. The particle size of glass beads (G) is in the range of from 50μ(micrometers) to 1500μ, preferably 80 μ to 1250 μ, more preferably in the range of from 100 μ to 1000 μ. Glass beads can be obtained from various commercial sources like Potters Industries, Inc. (PQ Corporation), Swarco Industries, Inc., Minnesota Mining and Manufacturing Company (3M), and others. Typical glass beads useful for this application are those described in AASHTO Designation M 247-81 (1993), developed by the American Association of State Highway and Transportation Officials (Washington, D.C.). The beads will generally be applied at a rate of 0.72 kg/L to 2.9 kg/L or more of paint for night and adverse weather visibility.

An "auxiliary material" also may be mixed with one or more of components A, B, C, and D to provide additional benefits. Such auxiliary materials typically do not chemically interact to contribute to quick setting, fast drying properties, in any significant way, with the binder, water, or other components in the coating composition. A portion of the glass beads, quartz beads or ceramic beads which generally provide reflective properties to traffic paints or road marking coatings may be viewed as such an "auxiliary material". This will be true for those glass beads that are completely buried below the surface of the dried traffic paint or road marking to the extent that they do not interact with incident light in a significant way.

Other auxiliary materials may also be combined with any of components A, B, C, and D. These other auxiliary materials include those known to provide anti-skidding properties, such as various forms of quartz silicas. In addition, other auxiliary materials may provide certain physical/chemical benefits such as additional drying acceleration, uniformity of drying, better flow properties, or a combination thereof. It is important that an auxiliary material maintain its desirable performance features and those of components A, B, C, and D during application. For this reason, inclusion of some auxiliary materials with certain components (A, B, C, or D) must be avoided. For example, these auxiliary materials include salts that are hygroscopic and/or soluble in water, such as CaCl2, calcium acetate, or acids, such as acetic acid, citric acid and others. It would not be appropriate to combine these hygroscopic substances with aqueous components B or C prior to application to a substrate because those salts would lose their ability to absorb water upon application and because they might destabilize components B or C prior to application. If the auxiliary materials are to be mixed with any of components A, B, C, or D prior to application, they must be chemically and physically compatible with those components.

The absorber, with or without any other auxiliary materials or other substances, and the binder must be placed in separate components (packs). The component including the absorber (component A) and the component(s) including the binder(s) (components B and C) as part of the coating formulation must be kept separate until the time of application onto the surface of a substrate. Substrates include highway, road, street, runway, parking area, tarmac, pavement and roof, and surface material(s), masonry, asphalt, concrete, cement, stone, metals such as aluminum, stainless steel, carbon steel, etc.

Although talc may itself be used as an absorber, it may also be combined with other absorbers to impart improved flow characteristics and lighter color. Talc is particularly useful in this regard when the absorber is, for example, an IER having a high water content because the talc prevents the moisture laden IER beads from adhering to one another, a condition that would adversely manifest itself as clumping, compacting, and bridging during storage and application.

The Table I listing shows several ways by which "G" and the components A, B, C, and D may be applied to a substrate in a series of sequential steps. As noted supra, when glass beads are added in a step that does not include any of the components A, B, or C, those glass beads are defined as including component D as shown in Table I. When glass beads are added in one of the sequential steps with one or more of components A, B, and C (i.e., when added simultaneously, or nearly simultaneously with one or more of components A, B, and C), those glass beads are denoted by "G", as shown in Table I. When more than one of "G" and components A, B, and C are being added in a single sequential step, a comma is used in Table I to denote simultaneous, or nearly simultaneous, addition. Inclusion in parentheses further denotes premixing. Although not explicitly stated in Table I, it is also within the scope of the present invention that any of the sets of sequential steps of any method of Table I may be repeated one or more times or in combination with other steps in other methods. In other words, it is understood that there are other variations which may be used that repeat one or more of the steps. Further, it is possible to use component A in multiple steps of a single method provided that component A is not premixed with either component B or component C.

TABLE I

| Method | First Step | Second Step | Third Step | Fourth Step |
|---|---|---|---|---|
| 1 | A | B | | |
| 2 | A, G | B | | |
| 3 | (A, G) | B | | |
| 4 | A | D | B | |
| 5 | A | B | D | |
| 6 | C | A | B | |
| 7 | C | A, G | B | |
| 8 | C | (A, G) | B | |
| 9 | C | A | B, G | |
| 10 | C | A | (B, G) | |
| 11 | C | A | B | D |
| 12 | C | B, A | D | |
| 13 | B, G | A | | |
| 14 | (B, G) | A | | |

Components in a parenthesis are pre-mixed prior to application. If two or more components are in the same step box, these components are applied simultaneously, or substantially simultaneously.
A: Component A, including absorber;
B: Component B, including binder;
C: Component C, including binder;
D: Component D, including glass beads;
G: glass beads The paint or coating, particularly the component containing the binder, can be applied to the surface of a substrate by a number of ways known to those having ordinary skill in the art. Some examples are brushing, spraying, extrusion, and combinations thereof. All of these different ways are collectively referred to as "spraying" or "application" herein.

One method of application of the absorber to the road marking paint, disclosed in U.S. Pat. No. 5,947,632, is to spray the paint, followed by any glass beads, and then finally to spray the absorber. Alternatively, the absorber may be applied before or together with application of the glass beads, or even incorporated into the fan of paint as it is sprayed. The present invention provides improvement upon the methods of U.S. Pat. No. 5,947,632. The methods of the present invention include applying the absorber prior to application of at least one of binder components B and C. In cases where the absorber is applied either in the same step with a binder component, or in a previous step to the final step that includes a binder component, the absorber is less likely to bounce off the surface of the paint. Furthermore, the absorber is more likely to be covered by a layer of paint. Such coverage assures that the full ability of the absorber to accelerate drying will be realized, and that any undesirably colored particles will be hidden beneath the surface of the film, rendering them unobjectionable, or less objectionable. The rate of application of the particles depends on the rate of drying required, the overall formulation of the paint, the application conditions, the application methods and combinations thereof. If the absorber used can also impart some reflective properties, e.g., when the absorber is a translucent or transparent IER, the amount of glass beads required may be reduced (infra). Methods 6 through 12 are preferred.

The absorber may be applied in conjunction with the acid or salt solution treatments disclosed in EP-B-0200249 and described herein above. If chemically and physically compatible, the absorber particles may be mixed with a salt or an acid prior to application. Alternatively, they can be kept separate and applied separately.

Absorber may, in addition, be applied after the application of the paint has been completed. Exercise of this option may be particularly useful for road-marking paint. This use can be by design, or as a remedial step. The term "remedial step" means that if a road-marking crew has applied by the usual means a waterborne road-marking paint and they find that it is not drying quickly enough, they can accelerate drying by applying the absorber particles in accordance with the invention. One such situation is in the case of a waterborne road-marking operation which commences under favorable climatic conditions (e.g. 20° C. and 50% relative humidity), but is being finished under unfavorable conditions such as a lower temperature of 10° C. and a higher relative humidity of 85%. The more recently applied waterborne road markings will dry more slowly than expected and this will cause prolonged traffic flow interruption. In such a case, the road-marking crew can post-treat the more recently applied road-markings with the absorber particles. This will cause an increase of drying rate of the more recently applied waterborne road-markings and allow faster resumption of normal traffic flow.

AMBERJET®, AMBERLYST®, AMBERLITE®, AMBERSORB®, AND ROPAQUE®, are registered trademarks of Rohm and Haas Company, NAFION® is a registered trademark of E. I. duPont De Nemours and Company, CELITE® is a registered trademark of Johns-Manville Corporation, and AQUALIC® is a registered trademark of Nippon Shokubai Kagaku Kogyo Co., Ltd.

Examples 1–24 (Table III) were carried out in the following manner:

Dry Through Tests

Each test paint was applied to a 4" (10.2 cm)×12" (30.5 cm) glass panel using a drawdown blade having a gap of either 20 or 40 mils (about 500 $\mu$ or 1000 $\mu$), followed immediately by the application of a given absorber to a section of the panel. Each absorber was applied in such a fashion that it covered about one third (⅓) of the coated glass panel, with another ⅓ covered by one of the glass bead types, and the other third remaining untreated. Absorbers were applied using a hand shaker such that the coverage of the absorber was evenly distributed across the surface, and applied in an amount approximating 100 g per $m^2$ of paint surface area. Glass beads were applied at a similar coverage density, which corresponds to about 250 g of glass beads per $m^2$ of paint surface area.

After application of the coating, with and without the treatment of absorber and glass beads, the panels were then immediately placed in a high humidity test chamber supplied by Victor Associates, Inc. (Hatboro, Pa.), maintained at a relative humidity of 90%±3%. This test chamber is equipped with a certified hygrometer and temperature indicator, both of which were fastened to the center of the rear wall of the test chamber to ensure balanced measurement. The 90%±3% relative humidity was obtained by filling the pan at the bottom of the completely closed test chamber with a 1 inch layer of water, equilibrating the chamber overnight (about 16 hours) before testing (bringing the relative humidity inside the chamber to 100%), and then adjusting the size of the side port openings to achieve a relative humidity of 90%±3% within the chamber. The temperature inside the test chamber was 23° C. (74° F.).

The door of the test chamber was opened briefly at 5-minute intervals to evaluate the dry through time for the paint test panel on each of the three test areas (absorber, glass, and untreated). Dry through time is defined as the time it takes for a wet paint film to reach a state such that the paint cannot be distorted with a 90° thumb twist when the thumb is touching the paint surface, but no pressure is being applied. During the early stages of drying, dry through is assessed by pushing a small applicator stick through the surface of the film to the substrate, and then gauging the dryness of the coating in the lower layer by dragging the applicator stick along the substrate for a length of approximately 0.5 inch (~1.27 cm). As it becomes clear that the coating is approaching a dried through state, the panel is then removed from the box at the appropriate time, and the aforementioned 90° thumb twist test is conducted.

The compositions of various test paints are as shown in Table II. All numbers in columns A, B, and C are in grams. Paints A, B, and C are typically referred to as "fast drying" or "quick setting" paints.

TABLE II

| MIX | Paint Formulation A | Paint Formulation B | Paint Formulation C |
|---|---|---|---|
| FASTRACK ® 2706 | 460.1 | — | — |
| FASTRACK ® 3427 | — | 455.5 | — |
| FASTRACK ® HD-21 | — | — | 467.9 |
| TAMOL ® 901 (30%) | 7.2 | 5.0 | 7.1 |
| SURFYNOL ® CT-136 | 2.8 | 2.8 | 2.8 |
| DREWPLUS ® L-493 | 2.0 | 3.0 | 2.0 |
| TI-PURE ® R-900 | 100.0 | 100.0 | 100.0 |
| OMYACARB ®-5 | 760.6 | 760.6 | 760.3 |
| After 15 minutes, add | | | |
| Methanol | 30.0 | 30.0 | 30.0 |
| TEXANOL ® | 23.0 | 18.4 | 23.0 |
| DREWPLUS ® L-493 | 3.5 | 2.5 | 3.5 |
| NATROSOL ® 250 HR (2%) | 7.0 | 12.0 | 4.5 |
| Water | 11.6 | 17.6 | 6.9 |
| Total weight (g) | 1407.8 | 1407.4 | 1408.0 |

RHOPLEX ® and TAMOL ® (registered trademarks); FASTRACK ® 2706, FASTRACK ® 3427, and FASTRACK ® HD-21 binders and TAMOL ® 901 Dispersant, an ammonium salt of a polyelectrolyte supplied at 30 percent solids, were supplied by Rohm and Haas Company, Philadelphia, Pennsylvania @ 30 percent based on the solids; SURFYNOL ® (a registered trademark) CT-136 Surfactant, an acetylenic surfactant was supplied by Air Products and Chemicals, Inc., Allentown, Pennsylvania; DREWPLUS ® (a registered trademark) L-493 defoamer supplied by Ashland Chemical Company, Drew Industrial Division, Boonton, New Jersey; TI-PURE ® (a registered trademark) R-900 titanium dioxide was supplied by E.I. duPont de Nemours & Company, Wilmington, Delaware; OMYACARB ®-5 (a registered trademark) was supplied by Pluess-Staufer Industries, Inc., Proctor, Vermont; TEXANOL ® (a registered trademark) ester alcohol was supplied by Eastman Chemicals, Kingsport, Tennessee; NATROSOL ® (a registered trademark) was obtained from Hercules Incorporated.

The results are shown below in Table III.

TABLE III

| Empl. No. | Absorber or Auxiliary Material | Paint Formulation (from Table II) | Dry-through Time (min.) | Draw-down gap |
|---|---|---|---|---|
| 1 | None | C | 80 | 20 mils |
| 2 | P35 (glass) | C | 90 | 20 mils |
| 3 | AC07 (glass) | C | 90 | 20 mils |
| 4 | AMBERLITE ® 1200H | C | 20 | 20 mils |
| 5 | AMBERJET ® 120H | C | 20 | 20 mils |
| 6 | AMBERLITE ® XE-64 | C | 25 | 20 mils |
| 7 | AMBERLITE ® IRC-84SP | C | 25 | 20 mils |
| 8 | AMBERLITE ® A-15 | C | 30 | 20 mils |
| 9 | AQUALIC ® CA | C | 15 | 20 mils |
| 10 | None | C | 180 | 40 mils |

TABLE III-continued

| Empl. No. | Absorber or Auxiliary Material | Paint Formulation (from Table II) | Dry-through Time (min.) | Draw-down gap |
|---|---|---|---|---|
| 11 | AC07 (glass) | C | >180 | 40 mils |
| 12 | AMBERLITE ® 1200H | C | 65 | 40 mils |
| 13 | ZEOLITE ® 4A | C | 35 | 20 mils |
| 14 | ZEOLEX ® 80 | C | 30 | 20 mils |
| 15 | Carbon Black | C | 60 | 20 mils |
| 16 | AMBERSORB ® 563 | C | 40 | 20 mils |
| 17 | MICROTALC ™ MP 25-38 | C | 40 | 20 mils |
| 18 | ROPAQUE ® OP-62 LO (spray dried) | C | 30 | 20 mils |
| 19 | None | A | 35 | 20 mils |
| 20 | AC07 (glass) | A | 40 | 20 mils |
| 21 | AMBERLITE ® IRC-84SP | A | 10 | 20 mils |
| 22 | None | B | 40 | 20 mils |
| 23 | AC07 (glass) | B | 45 | 20 mils |
| 24 | AMBERLITE ® IRC-84SP | B | 10 | 20 mils |

P35 and AC07 were obtained from Potters Industries (PQ Corporation); A drawdown gap of "20 mils" is equivalent to about 500 m and "40 mils", about 1000 m. (the resulting wet film thicknesses are approximately 13 mils (330 m) and 25 mils (635 m) respectively). MICROTALC ™ MP 25-38 is a talc made by Whittaker, Clark, and Daniels, Inc.

These examples showed that addition of the selected absorbers under the disclosed conditions improved (accelerated) drying of a variety of water-borne coating compositions by using the described testing method.

All the examples herein are intended for illustrative purposes only. They are not intended to limit the spirit or scope of the present invention which is defined by the claims.

We claim:

1. A method for preparing a fast drying multi-component waterborne coating on a surface of a substrate, the method comprising the sequential steps of:

a) applying component A consisting essentially of at least one water insoluble absorber to the surface of the substrate;

b) applying component B consisting essentially of a fast-drying binder composition to the surface of the substrate to which the water insoluble absorber has been applied; and c) allowing the multi-component waterbome coating to dry, wherein said absorber is selected from the group consisting of organic super absorbent polymers, ion-exchange resins, hollow sphere polymers, molecular sieves, talcs, inorganic absorbers, porous carbonaceous materials, non-porous carbonaceous materials, and mixtures thereof.

2. The method of claim 1, further comprising the additional sequential step of applying component C comprising a fast-drying binder composition to the surface of the substrate before applying said component A water insoluble absorber;

wherein said component C is different from said component B.

3. A method according to claim 1, wherein said fast drying binder composition comprises: an aqueous dispersion comprising:

(i) anionically stabilized polymer having Tg of greater than −10° C.;

(ii) polyamine functional polymer; and (iii) volatile base in an amount sufficient to deprotonate the conjugate acid of said polyamine functional polymer.

4. A method according to claim 1, wherein said fast drying binder composition comprises: an aqueous dispersion comprising:

(i) a polyamine functional polymer that is a latex polymer having pendant amine-functional groups, wherein such latex polymer has a Tg equal to or greater than −10° C.; and (ii) volatile base in an amount sufficient to deprotonate the conjugate acid of said polyamine functional polymer.

5. A method according to claim 1, wherein said fast drying binder composition comprises: an aqueous dispersion comprising:

(i) a polyamine functional polymer that is a latex polymer having pendant amine-functional groups and pendant acid-functional groups, wherein the ratio of amine-functional groups to acid-functional groups is greater than 3 to 1, and wherein said latex polymer has a Tg equal to or greater than −10° C.; and (ii) volatile base in an amount sufficient to deprotonate the conjugate acid of said polyamine functional polymer.

6. A method according to claim 1, wherein said fast drying binder composition comprises: an aqueous dispersion comprising:

(i) a polyamine functional polymer that is a latex polymer having pendant amine-functional groups, wherein said latex polymer having pendant amine-functional groups has a Tg equal to or greater than −10° C.;

(ii) a latex polymer having pendant acid-functional groups, wherein said latex polymer having acid-functional groups has a Tg equal to or greater than −10° C.; and (iii) volatile base in an amount sufficient to deprotonate the conjugate acid of said polyamine functional polymer.

7. A method according to claim 1, wherein said fast drying binder composition comprises: an aqueous dispersion comprising:

(i) an aqueous emulsion containing a polyamine functional polymer, having a Tg equal to or greater than −10° C., formed from polymerizable monomers comprising:

(a) alkyl esters of acrylic or methacrylic acid having an alkyl ester portion containing between 1 to 18 carbon atoms;

(b) from 0.1 to 5% by weight, based on said acrylic film forming polymer, of a at least one secondary or tertiary aminoacrylate monomer, or secondary or tertiary aminomethacrylate monomer; and (c) from 0.1 to 5% by weight, based on said acrylic film forming of crosslinkable monomer selected from the group consisting of acrylamide, methacrylamide, and N-alkylol acrylamide; and said polyamine functional polymer having less than 3 percent by weight, based on said film forming polymer of hydrophilic monomer incorporated therein; and (ii) volatile base in an amount sufficient to deprotonate the conjugate acid of said polyamine functional polymer.

8. A method according to claim 1, wherein said fast drying binder composition comprises:

(i): an aqueous dispersion comprising: polymer having pendant strong cationic groups, wherein said polymer having pendant strong cationic groups has a Tg equal to or greater than −10° C.; and (ii): an aqueous dispersion comprising: polymer having pendant weak acid groups, wherein said polymer having pendant weak acid groups has a Tg equal to or greater than −10° C.; and wherein aqueous dispersion (i) and aqueous dispersion (ii) may be applied to said surface of a substrate in any order as part of said fast drying binder composition.

9. A method according to claim 1, wherein said fast drying binder composition comprises: an aqueous dispersion comprising:

(i): polymer having both pendant strong cationic groups and pendant weak acid groups, wherein said polymer has a Tg equal to or greater than −10° C.; and wherein it is a necessary condition that said surface of a substrate is, or is treated to be, sufficiently basic that said aqueous dispersion sets in less time than the time required for a latex that only contains pendant strong cation groups, or pendant weak acid groups, to set.

10. A method according to claim 2, wherein said fast drying binder composition comprises: an aqueous dispersion comprising: (i) anionically stabilized polymer having Tg of greater than −10° C.; (ii) polyamine functional polymer; and (iii) volatile base in an amount sufficient to deprotonate the conjugate acid of said polyamine functional polymer.

11. A method according to claim 2, wherein said fast drying binder composition comprises: an aqueous dispersion comprising: (i) a polyamine functional polymer that is a latex polymer having pendant amine-functional groups, wherein such latex polymer has a Tg equal to or greater than −10° C.; and (ii) volatile base in an amount sufficient to deprotonate the conjugate acid of said polyamine functional polymer.

12. A method according to claim 2, wherein said fast drying binder composition comprises: an aqueous dispersion comprising:

(i) a polyamine functional polymer that is a latex polymer having pendant amine-functional groups and pendant acid-functional groups, wherein the ratio of amine-functional groups to acid-functional groups is greater than 3 to 1, and wherein said latex polymer has a Tg equal to or greater than −10° C.; and (ii) volatile base in an amount sufficient to deprotonate the conjugate acid of said polyamine functional polymer.

13. A method according to claim 2, wherein said fast drying binder composition comprises: an aqueous dispersion comprising:

(i) a polyamine functional polymer that is a latex polymer having pendant amine-functional groups, wherein said latex polymer having pendant amine-functional groups has a Tg equal to or greater than −10° C.;

(ii) a latex polymer having pendant acid-functional groups, wherein said latex polymer having acid-functional groups has a Tg equal to or greater than −10° C.; and (iii) volatile base in an amount sufficient to deprotonate the conjugate acid of said polyamine functional polymer.

14. A method according to claim 2, wherein said fast drying binder composition comprises: an aqueous dispersion comprising:

(i) an aqueous emulsion containing a polyamine functional polymer, having a Tg equal to or greater than −10° C., formed from polymerizable monomers comprising:

(a) alkyl esters of acrylic or methacrylic acid having an alkyl ester portion containing between 1 to 18 carbon atoms;

(b) from 0.1 to 5% by weight, based on said acrylic film forming polymer, of a at least one secondary or tertiary aminoacrylate monomer, or secondary or tertiary aminomethacrylate monomer; and (c) from 0.1 to 5% by weight, based on said acrylic film forming of crosslinkable monomer selected from the group consisting of acrylamide, methacrylamide, and N-alkylol acrylamide; and said polyamine functional polymer having less than 3 percent by weight, based on said film forming polymer of hydrophilic monomer incorporated therein; and (ii) volatile base in an amount sufficient to deprotonate the conjugate acid of said polyamine functional polymer.

15. A method according to claim 2, wherein said fast drying binder composition comprises:

(i): an aqueous dispersion comprising: polymer having pendant strong cationic groups, wherein said polymer having pendant strong cationic groups has a Tg equal to or greater than −10° C.; and (ii): an aqueous dispersion comprising: polymer having pendant weak acid groups, wherein said polymer having pendant weak acid groups has a Tg equal to or greater than −10° C.; and wherein aqueous dispersion (i) and aqueous dispersion (ii) may be applied to said surface of a substrate in any order as part of said fast drying binder composition.

16. A method according to claim 2, wherein said fast drying binder composition comprises: an aqueous dispersion comprising:

(i): polymer having both pendant strong cationic groups and pendant weak acid groups, wherein said polymer has a Tg equal to or greater than −10° C.; and wherein it is a necessary condition that said surface of a substrate is, or is treated to be, sufficiently basic that said aqueous dispersion sets in less time than the time required for a latex that only contains pendant strong cation groups, or pendant weak acid groups, to set.

17. A method for preparing a fast drying multi-component waterborne coating on a surface of a substrate, the method comprising the sequential steps of:

a) applying component C comprising a fast-drying binder composition to the surface of the substrate;

b) applying component A consisting essentially of at least one water insoluble absorber and component B consisting essentially of a fast-drying binder composition simultaneously, or nearly simultaneously, to the surface of the substrate to which said component C has already been applied; and c) allowing the multi-component waterborne coating to dry;

wherein said component B is different from said component C; and wherein said absorber is selected from the group consisting of organic super absorbent polymers, ion-exchange resins, hollow sphere polymers, molecular sieves, talcs, inorganic absorbers, porous carbonaceous materials, non-porous carbonaceous materials, and mixtures thereof.

18. A method according to claim 17, wherein said fast drying binder composition comprises: an aqueous dispersion comprising: (i) anionically stabilized polymer having Tg of greater than −10° C.; (ii) polyamine functional polymer; and (iii) volatile base in an amount sufficient to deprotonate the conjugate acid of said polyamine functional polymer.

19. A method according to claim 17, wherein said fast drying binder composition comprises: an aqueous dispersion comprising: (i) a polyamine functional polymer that is a latex polymer having pendant amine-functional groups, wherein such latex polymer has a Tg equal to or greater than −10° C.; and (ii) volatile base in an amount sufficient to deprotonate the conjugate acid of said polyamine functional polymer.

20. A method according to claim 17, wherein said fast drying binder composition comprises: an aqueous dispersion comprising:

(i) a polyamine functional polymer that is a latex polymer having pendant amine-functional groups and pendant acid-functional groups, wherein the ratio of amine-functional groups to acid-functional groups is greater than 3 to 1, and wherein said latex polymer has a Tg equal to or greater than −10° C.; and (ii) volatile base in an amount sufficient to deprotonate the conjugate acid of said polyamine functional polymer.

21. A method according to claim 17, wherein said fast drying binder composition comprises: an aqueous dispersion comprising:

(i) a polyamine functional polymer that is a latex polymer having pendant amine-functional groups, wherein said latex polymer having pendant amine-functional groups has a Tg equal to or greater than −10° C.;

(ii) a latex polymer having pendant acid-functional groups, wherein said latex polymer having acid-functional groups has a Tg equal to or greater than −10° C.; and (iii) volatile base in an amount sufficient to deprotonate the conjugate acid of said polyamine functional polymer.

22. A method according to claim 17, wherein said fast drying binder composition comprises: an aqueous dispersion comprising:

(i) an aqueous emulsion containing a polyamine functional polymer, having a Tg equal to or greater than −10° C., formed from polymerizable monomers comprising:

(a) alkyl esters of acrylic or methacrylic acid having an alkyl ester portion containing between 1 to 18 carbon atoms;

(b) from 0.1 to 5% by weight, based on said acrylic film forming polymer, of a at least one secondary or tertiary aminoacrylate monomer, or secondary or tertiary aminomethacrylate monomer; and (c) from 0.1 to 5% by weight, based on said acrylic film forming of crosslinkable monomer selected from the group consisting of acrylamide, methacrylamide, and N-alkylol acrylamide; and said polyamine functional polymer having less than 3 percent by weight, based on said film forming polymer of hydrophilic monomer incorporated therein; and (ii) volatile base in an amount sufficient to deprotonate the conjugate acid of said polyamine functional polymer.

23. A method according to claim 17, wherein said fast drying binder composition comprises:

(i): an aqueous dispersion comprising: polymer having pendant strong cationic groups, wherein said polymer having pendant strong cationic groups has a Tg equal to or greater than −10° C.; and (ii): an aqueous dispersion comprising: polymer having pendant weak acid groups, wherein said polymer having pendant weak acid groups has a Tg equal to or greater than −10° C.; and wherein aqueous dispersion (i) and aqueous dispersion (ii) may be applied to said surface of a substrate in any order as part of said fast drying binder composition.

24. A method according to claim 17, wherein said fast drying binder composition comprises: an aqueous dispersion comprising:

(i): polymer having both pendant strong cationic groups and pendant weak acid groups, wherein said polymer has a Tg equal to or greater than −10° C.; and wherein it is a necessary condition that said surface of a substrate is, or is treated to be, sufficiently basic that said aqueous dispersion sets in less time than the time required for a latex that only contains pendant strong cation groups, or pendant weak acid groups, to set.

25. A method for preparing a fast drying multi-component waterborne coating on a surface of a substrate, the method comprising the sequential steps of:

a) applying component B consisting essentially of a fast-drying binder composition and glass beads to the surface of the substrate;

b) applying component A consisting essentially of at least one water insoluble absorber to the surface of the substrate to which component B has been applied; and c) allowing the multi-component waterborne coating to dry, wherein said absorber is selected from the group consisting of organic super absorbent polymers, ion-exchange resins, hollow sphere polymers, molecular sieves, talcs, inorganic absorbers, porous carbonaceous materials, non-porous carbonaceous materials, and mixtures thereof.

26. A method according to claim 25, wherein said fast drying binder composition comprises: an aqueous dispersion comprising: (i) anionically stabilized polymer having Tg of greater than −10° C.; (ii) polyamine functional polymer; and (iii) volatile base in an amount sufficient to deprotonate the conjugate acid of said polyamine functional polymer.

27. A method according to claim 25, wherein said fast drying binder composition comprises: an aqueous dispersion comprising: (i) a polyamine functional polymer that is a latex polymer having pendant amine-functional groups, wherein such latex polymer has a Tg equal to or greater than −10° C.; and (ii) volatile base in an amount sufficient to deprotonate the conjugate acid of said polyamine functional polymer.

28. A method according to claim 25, wherein said fast drying binder composition comprises: an aqueous dispersion comprising:

(i) a polyamine functional polymer that is a latex polymer having pendant amine-functional groups and pendant acid-functional groups, wherein the ratio of amine-functional groups to acid-functional groups is greater than 3 to 1, and wherein said latex polymer has a Tg equal to or greater than −10° C.; and (ii) volatile base in an amount sufficient to deprotonate the conjugate acid of said polyamine functional polymer.

29. A method according to claim 25, wherein said fast drying binder composition comprises: an aqueous dispersion comprising:

(i) a polyamine functional polymer that is a latex polymer having pendant amine-functional groups, wherein said latex polymer having pendant amine-functional groups has a Tg equal to or greater than −10° C.;

(ii) a latex polymer having pendant acid-functional groups, wherein said latex polymer having acid-functional groups has a Tg equal to or greater than −10° C.; and (iii) volatile base in an amount sufficient to deprotonate the conjugate acid of said polyamine functional polymer.

30. A method according to claim 25, wherein said fast drying binder composition comprises: an aqueous dispersion comprising:

(i) an aqueous emulsion containing a polyamine functional polymer, having a Tg equal to or greater than −10° C., formed from polymerizable monomers comprising:

(a) alkyl esters of acrylic or methacrylic acid having an alkyl ester portion containing between 1 to 18 carbon atoms;

(b) from 0.1 to 5% by weight, based on said acrylic film forming polymer, of a at least one secondary or tertiary aminoacrylate monomer, or secondary or tertiary aminomethacrylate monomer; and (c) from 0.1 to 5% by weight, based on said acrylic film forming of crosslinkable monomer selected from the group consisting of acrylamide, methacrylamide, and N-alkylol acrylamide; and said polyamine functional polymer having less than 3 percent by weight, based on said film forming polymer of hydrophilic monomer incorporated therein; and (ii) volatile base in an amount sufficient to deprotonate the conjugate acid of said polyamine functional polymer.

31. A method according to claim 25, wherein said fast drying binder composition comprises:

(i): an aqueous dispersion comprising: polymer having pendant strong cationic groups, wherein said polymer having pendant strong cationic groups has a Tg equal to or greater than −10° C.; and (ii): an aqueous dispersion comprising: polymer having pendant weak acid groups, wherein said polymer having pendant weak acid groups has a Tg equal to or greater than −10° C.; and wherein aqueous dispersion (i) and aqueous dispersion (ii) may be applied to said surface of a substrate in any order as part of said fast drying binder composition.

32. A method according to claim 25, wherein said fast drying binder composition comprises: an aqueous dispersion comprising:

(i): polymer having both pendant strong cationic groups and pendant weak acid groups, wherein said polymer has a Tg equal to or greater than −10° C.; and wherein it is a necessary condition that said surface of a substrate is, or is treated to be, sufficiently basic that said aqueous dispersion sets in less time than the time required for a latex that only contains pendant strong cation groups, or pendant weak acid groups, to set.

33. The method of any one of claims 1 through 16, wherein said component A consists essentially of at least one water insoluble absorber and glass beads.

34. The method of any one of claims 1 through 16, wherein said component B consists essentially of a fast-drying binder and glass beads.

35. The method of any one of claims 2 or 10 through 16, wherein said component C further comprises glass beads.

36. The method of any one of claims 1, or 3 through 9, further comprising the step of applying component D comprising glass beads before applying the first applied of said components A and B.

37. The method of any one of claims 2 or 10 through 16, further comprising the step of applying component D comprising glass beads before applying the first applied of said components A, B, and C.

38. The method of any one of claims 1, 3 through 9, further comprising the step of applying said component D comprising glass beads between of any two steps of applying said components A and B.

39. The method of any one of claims 2 or 10 through 16, further comprising the step of applying said component D comprising glass beads between of any two steps of applying said components A, B, and C.

40. The method of any one of claims 1, or 3 through 9, further comprising the step of applying component D comprising glass beads after applying the last applied of said components A and B.

41. The method of any one of claims 2 or 10 through 16, further comprising the step of applying component D comprising glass beads after applying the last applied of said components A, B, and C.

42. The method of any one of claims 1 through 32, wherein said ion exchange resin comprises acid functionality selected from the group consisting of sulfonate, carboxylate, phosphonate, aminophosphonate, their salts, and mixtures thereof.

43. The method of any one of claims 1 through 32, wherein the ion exchange resin is transparent or translucent.

44. The method of any one of claims 1 through 16, wherein said organic super absorbent polymer comprises a polymer prepared from at least one monomer selected from the group consisting of acrylic monomer, methacrylic monomer, and mixtures thereof.

45. The method of any one of claims 1 through 32, further comprising the step of applying an aqueous solution which comprises a substance selected from the group consisting of an acid, a water soluble salt and mixtures thereof, wherein the acid is selected from the group consisting of acetic acid, citric acid and mixtures thereof.

46. The method of any one of claims 1 through 16, wherein the multi-component waterborne coating is a multi-component waterborne road marking paint.

47. A composite formed by the method of any one of claims 1 through 16.

* * * * *